US006408439B1

(12) United States Patent
Garforth-Crippen

(10) Patent No.: US 6,408,439 B1
(45) Date of Patent: Jun. 25, 2002

(54) GARMENT FOR USE IN A CHILD CAR SEAT

(76) Inventor: Julia R. Garforth-Crippen, 6096 Donna Jay Dr., Loveland, OH (US) 45140-8431

( * ) Notice: Subject to any disclaimer, the term of this patent is extended or adjusted under 35 U.S.C. 154(b) by 0 days.

(21) Appl. No.: 09/863,206

(22) Filed: May 21, 2001

Related U.S. Application Data

(60) Provisional application No. 60/205,391, filed on May 19, 2000.

(51) Int. Cl.[7] ..... A41D 11/00

(52) U.S. Cl. ..... 2/80

(58) Field of Search ..... 2/49.1, 49.2, 49.3, 2/49.4, 49.5, 46, 48, 50, 69.5, 75, 80, 270, 60, 111

(56) References Cited

U.S. PATENT DOCUMENTS

| | | | | | |
|---|---|---|---|---|---|
| 114,366 | A | * | 5/1871 | Thomson | |
| D59,555 | S | * | 11/1921 | Ladd | |
| D162,994 | S | * | 4/1951 | Savron | D3/26 |
| 2,563,161 | A | * | 8/1951 | Dixon | 2/80 |
| 2,578,323 | A | * | 12/1951 | Sillaway | 2/69.5 |
| 2,697,837 | A | * | 12/1954 | Goldman | 2/270 |
| 2,727,240 | A | * | 12/1955 | Marshall | 2/50 |
| 2,968,044 | A | * | 1/1961 | Dudley | 2/69.5 |
| 4,266,299 | A | * | 5/1981 | Beal | 2/46 |
| 4,304,006 | A | * | 12/1981 | Swart | 2/49 |
| D288,022 | S | * | 2/1987 | Marconi | D2/227 |
| 4,823,405 | A | * | 4/1989 | Porter | 2/80 |
| 4,884,298 | A | * | 12/1989 | Silas | 2/49 |
| 4,901,371 | A | * | 2/1990 | Christians | 2/69.5 |
| 5,125,117 | A | * | 6/1992 | Buenos et al. | 2/239 |
| 5,454,119 | A | * | 10/1995 | Thomm | 2/114 |
| 5,611,082 | A | * | 3/1997 | Bull | 2/79 |
| 6,081,923 | A | * | 7/2000 | Marks | 2/49.3 |
| 6,141,798 | A | * | 11/2000 | Manning | 2/49.1 |
| 6,216,269 | B1 | * | 4/2001 | Smith et al. | 2/46 |

* cited by examiner

*Primary Examiner*—John J. Calvert
*Assistant Examiner*—Alissa L. Hoey
(74) *Attorney, Agent, or Firm*—James J. Leary; Carol D. Titus

(57) ABSTRACT

A garment that can be donned while the wearer is seated, such as in a child car seat, has an upper portion that wraps around the wearer's torso from the front. There are fasteners along the edges that can be fastened behind the wearer. A pair of sleeves are attached to the front of the upper portion. Cuffs that fold over to form mitten-like hand coverings are attached to the ends of the sleeves. There is a neck opening having fasteners to secure behind the wearer's neck. A detachable bib panel attaches to the front of the upper portion. A lower portion extends downward and encloses the wearer's feet and legs. The lower portion is configured as a single pouch for enclosing both of the wearer's legs. Alternately, the lower portion is configured with two separate leg coverings. The leg coverings may be open, closed or have cuffs that fold over to form foot coverings.

19 Claims, 2 Drawing Sheets

GARMENT FOR USE IN A CHILD CAR SEAT

CROSS REFERENCE TO OTHER APPLICATIONS

This application claims the benefit of US Provisional Application No. 60/205,391, filed May 19, 2000, which is hereby incorporated by reference in its entirety.

FIELD OF THE INVENTION

The present invention relates to a garment. In particular, it relates to a garment for infants and children that can be donned while the wearer is seated, such as while seated in a child car seat, or the like.

BACKGROUND OF THE INVENTION

Throughout the United States, safety regulations require the use of child safety seats for infants and children under a certain age or size when riding in an automobile. Typically, the child car seat is mounted on one of the passenger seats of the car using a seat belt or other attachment mechanism. The child car seat includes a restraint system for holding the child in the car seat. The most common configurations for the child restraint system include a three-point restraint system and a five-point restraint system. A three-point restraint system typically has two shoulder straps, one over each of the child's shoulders, forming a V and a buckle at the vertex of the V for fastening the straps to the child car seat between the child's legs. Sometimes the shoulder straps are attached to a T-shield that buckles to the child car seat between the child's legs. A five-point restraint system typically has two shoulder straps, two waist straps - one on the left and one on the right, a crotch strap between the child's legs and a buckle for fastening the five straps together in front of the child. In some configurations, the shoulder straps are continuous with the waist straps.

Proper function of a child safety seat depends on proper fastening and adjustment of the restraint straps to keep the child in the seat in case of an accident. Most manufacturers of child safety seats warn that wrapping a child in a blanket before putting him or her in the car seat can interfere with the straps and buckles and inhibit the proper function of the restraint system. Similarly, loose or bulky garments, such as winter clothing, can affect the fit of the safety seat to the child and can interfere with the proper function of the restraint system. In cold climates this can be a very serious limitation. Few child safety seats are easily adjusted to account for the bulk of winter clothing. Consequently, the restraint system may be too tight when the child is in bulky clothing and/or too loose when the child is in lighter clothing. If a child is placed in a child safety seat wearing warm winter clothing, the restraint system may interfere with opening or loosening the garments, as may be necessary for temperature regulation and comfort of the child when the interior of the car warms up. A parent may be tempted to release the restraint system to adjust the child's clothing while the car is in motion, which is dangerous and illegal. However, allowing the child to overheat may also endanger the child. A parent should not have to make such choices between the comfort and the safety of a child. What is needed to solve this problem is a warm garment that can be donned while the child is seated in a child safety seat and that does not interfere with the proper function of the child safety seat or its restraint system.

SUMMARY OF THE INVENTION

The present invention provides a garment that can be donned while the wearer is in a seated position, such as while seated in a child safety seat, or the like, and that does not interfere with the proper function of the child safety seat or its restraint system. The garment has an upper portion that is sized to wrap around and cover the wearer's torso from the front. There are fasteners, such as snaps, buttons or hook-and-loop fasteners, along the lateral edges of the upper portion that can be fastened behind the wearer. A pair of sleeves are attached to the front of the upper portion. Cuffs that fold over to form mitten-like hand coverings are attached to the ends of the sleeves. There is a neck opening along the upper edge of the upper portion. The neck opening has fasteners, such as snaps or hook-and-loop fasteners, for closing the neck opening behind the wearer's neck. A detachable bib panel attaches to the front of the upper portion below the neck opening with fasteners, such as snaps, buttons or hook-and-loop fasteners. Attached to and extending downward from the upper portion is a lower portion sized to enclose the wearer's feet and legs. In one configuration, the lower portion is configured as a single pouch, which optionally has an elasticized upper edge, for enclosing both of the wearer's legs. In an alternate configuration, the lower portion is configured with two separate leg coverings. The leg coverings may be open or closed at the ends, or, optionally, may have cuffs that fold over to form foot coverings.

The garment is preferably made of a washable insulating fabric, such as polyester fleece. The bib panel is preferably made of a washable impermeable material. All of the materials used in the garment are preferably hypoallergenic and flame-retardant.

The configuration of the garment allows it to be donned while the wearer is in a seated position, such as while seated in a child's car seat, or the like. The garment does not interfere with the restraints on children's car seats. The garment can be wrapped around the wearer and fastened after the restraints of the car seat have been fastened.

While it is primarily intended for infants and toddlers up to approximately 40 pounds, the garment of the present invention can also be configured for use by larger children and even adults, such as those who are bedridden or wheelchair bound.

DETAILED DESCRIPTION OF THE INVENTION

Figure 1:
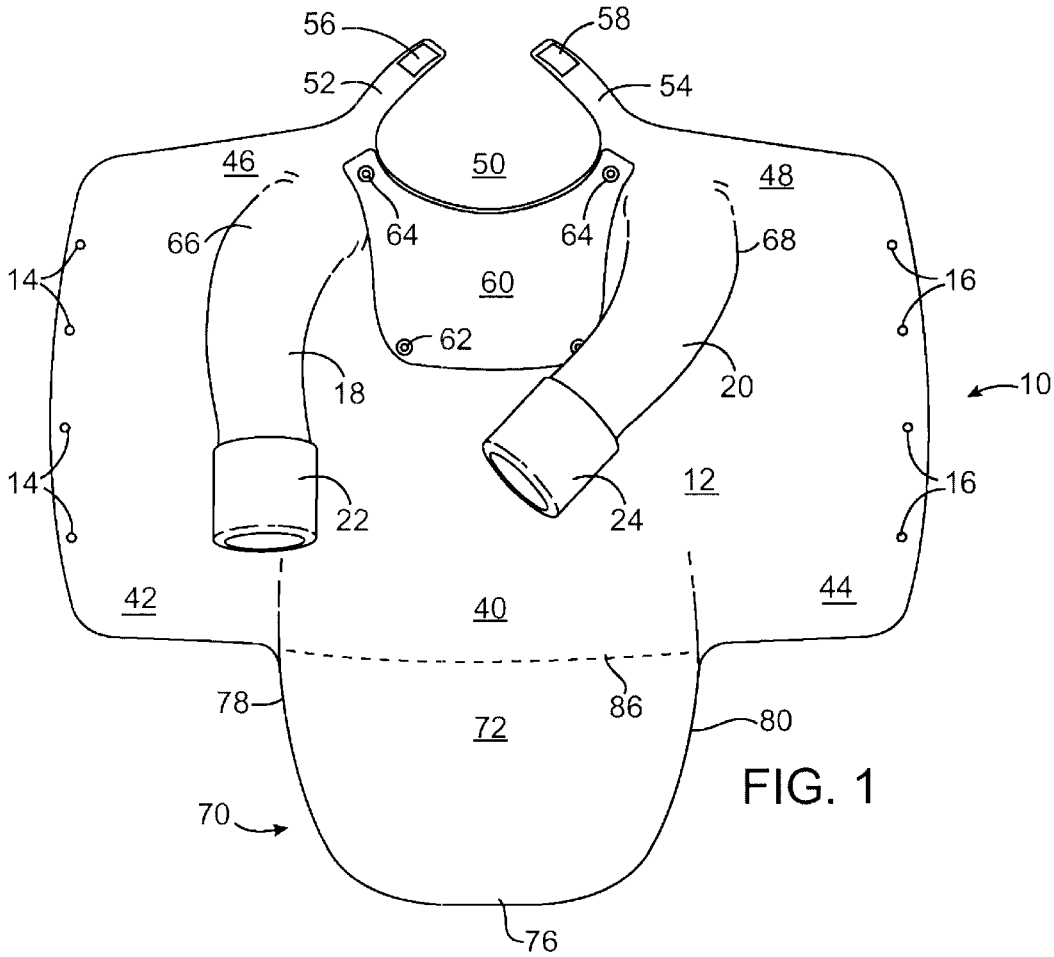
FIG. 1 shows a front view of the garment in an open position.
Figure 2:
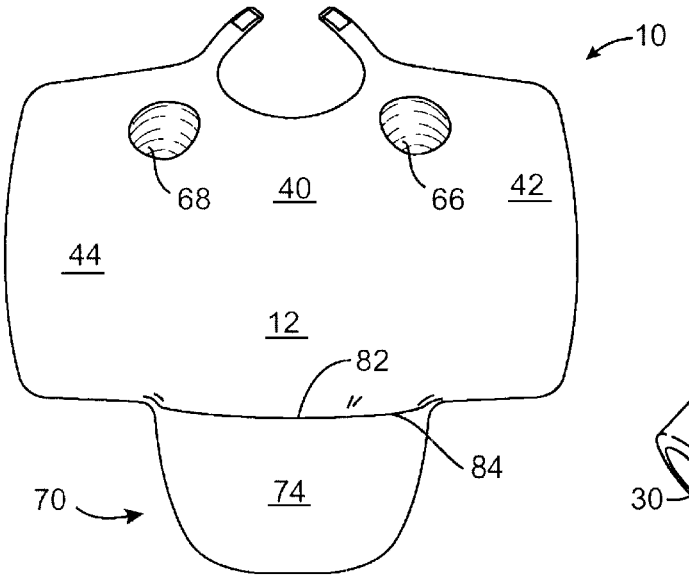
FIG. 2 shows an inside view of the garment.

FIG. 1 shows a front view of the garment 10 of the present invention in an open position. FIG. 2 shows an inside view of the garment 10 of FIG. 1 in the open position. The garment 10 is preferably made of a washable insulating fabric, which may be woven, nonwoven or knitted and may be stretchy or nonstretchy. One fabric which is particularly suitable for construction of the garment 10 is polyester fleece. All of the materials used in the garment 10 are preferably hypoallergenic and flame-retardant. The garment 10 may be constructed using known fabrication methods, such as sewing, adhesive bonding, heat welding, ultrasonic welding, or the like.

The garment 10 has an upper portion 12 that is sized to wrap around and cover the child's torso from the front. The upper portion 12 may be constructed of a single piece of cloth or from a plurality of pieces joined together. The upper portion 12 of the garment 10 has a front panel 40 that is sized and configured to cover the front of the child's torso from the shoulders to the hips. A right side extension 42 and a left side extension 44 are attached to the front panel 40 and are sized to cover the sides and back of the child's torso. A right shoulder panel 46 and a left shoulder panel 48 extend upward from the front panel 40 and from the right and left side extensions 42, 44. The upper edge of the front panel 40 has a concave cutout forming a neck opening 50 between the right shoulder panel 46 and the left shoulder panel 48. A right neck tab 52 and a left neck tab 54 extend upwards from the right shoulder panel 46 and the left shoulder panel 48, respectively, and around the neck opening 50. The right neck tab 52 and the left neck tab 54 have cooperating fasteners 56, 58, such as snaps, buttons or hook-and-loop fasteners, for fastening the neck opening 50 behind the child's neck. In an alternate construction, shown in FIG. 4, the right and left neck tabs 52, 54 may be replaced by a single neck tab 54' that passes behind the child's neck and fastens at one side of the neck opening 50.

There are cooperating fasteners 14, 16, such as snaps, buttons or hook-and-loop fasteners, along the lateral edges of the upper portion 12 for fastening the right side extension 42 and the left side extension 44 behind the child. Preferably, the fasteners 14, 16 are relatively flat and/or soft so that they do not cause any discomfort when they are fastened behind the child.

Figure 3:
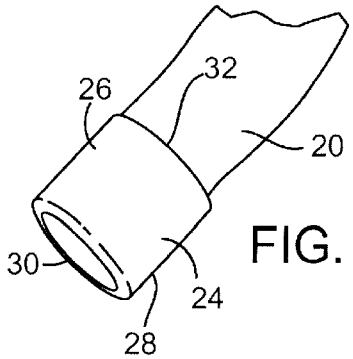
FIG. 3 shows a detail drawing of a sleeve of the garment.
Figure 4:
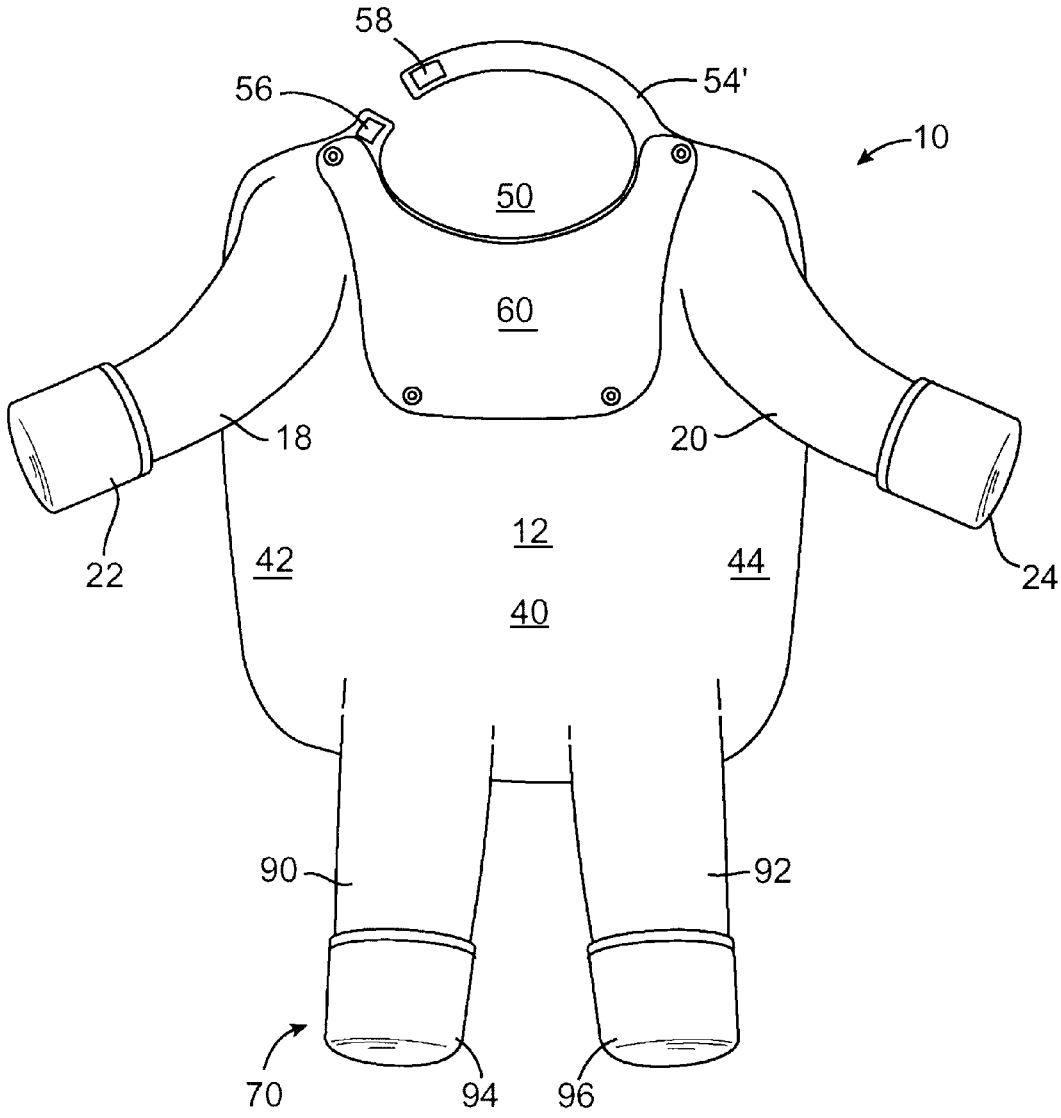
FIG. 4 shows a configuration of the garment having two separate leg coverings.

A right sleeve 18 and a left sleeve 20 are attached to the upper portion 12 of the garment 10 at armholes 66, 68 positioned where the front panel 40 joins the right and left side extensions 42, 44 just below the right and the left shoulder panels 46, 48. The sleeves 18, 20 are generally tubular in shape and are sized and configured to cover the child's arms from the shoulders to the wrists. Optionally, the garment 10 may include a pair of cuffs 22, 24 attached to the ends of the sleeves 18, 20, which can be folded over to form mitten-like hand coverings. FIG. 3 shows a detail drawing of the left sleeve 20 and cuff 24 of the garment 10. The cuff 24 is constructed from an approximately rectangular panel of cloth that is sewn to the sleeve 20 along first and second side seams 26, 28 and along an end seam 30 at the edge of the sleeve 20 to form a pocket that is open along its upper edge 32. The cuff 24 covers approximately half of the circumference of the sleeve 20, preferably on the back or dorsal side of the sleeve 20. To convert the cuffs 22, 24 to a warm mitten-like hand coverings, the pocket-shaped cuffs 22, 24 are inverted over the end of the sleeves 18, 20, as shown in FIG. 4. Alternatively, the garment 10 may be made with separate mittens or hand coverings, which may be attachable to the sleeves 18, 20 with hook-and-loop fasteners or the like.

Optionally, a detachable bib panel 60 attaches to the front panel 40 of the upper portion 12 just below the neck opening 50 with fasteners 62, 64, such as snaps, buttons or hook-and-loop fasteners. The bib panel 60 is preferably made of a washable impermeable material that protects the garment 10 from spills and stains. Alternatively, the bib panel 60 may be made disposable. In an alternate configuration, the bib panel 60 may be permanently attached to the front panel 40 of the upper portion 12.

Attached to and extending downward from the upper portion 12 is a lower portion 70 sized and configured to enclose the child's legs from approximately the hips to the feet. In one configuration, shown in FIG. 1, the lower portion 70 is configured as a single pocket or pouch for enclosing both of the child's legs. The pouch-like lower portion 70 is constructed with a lower front panel 72, which may be an extension or continuation of the front panel 40 or may be made from a separate piece joined to the front panel 40. A lower back panel 74 is joined to the lower front panel 72 along its bottom edge 76 and its lateral edges 78, 80 to form a pocket or pouch that is open along an upper edge 82 of the lower back panel 74, as shown in FIG. 2. Optionally, the upper edge 82 of the lower back panel 74 and/or the upper edge 86 of the lower front panel 72 may be edged with elastic or with a drawstring to tighten the lower portion 70 around the child's legs.

In an alternate configuration, shown in FIG. 4, the lower portion 70 is configured with two separate leg coverings 90, 92 attached near a lower edge of the upper panel. The leg coverings 90, 92 are generally tubular in shape and are sized and configured to enclose the child's legs from approximately the hips to the ankles or feet. The leg coverings 90, 92 may be open or closed at the ends or they may be made with optional leg cuffs 94, 96 that fold over to form foot coverings, similar to the cuffs 22, 24 on the sleeves 18, 20 described above. Optionally, a friction surface maybe applied to the bottom of the foot coverings for children who are old enough to walk. Alternatively, the garment 10 may be made with separate booties or foot coverings, which may be attachable to the leg coverings 90, 92 with hook-and-loop fasteners or the like.

In another alternate configuration, the pouch-like lower portion of FIG. 1 and the separate leg coverings of FIG. 4 can be integrated into a single garment to allow more flexibility in use.

The configuration of the garment 10 allows it to be donned while the child is in a seated position, such as while seated in a child's car seat, or the like. After the child is seated in the car seat and the restraints are properly adjusted and fastened, the garment 10 is placed on the child, over the straps of the restraint system. The simplest way to accomplish this is to slide the lower portion 70 up over the child's legs, stopping when the garment 10 contacts the crotch strap, buckle or T-shield of the restraint system. Then, the sleeves 18, 20 are slipped over the child's arms and the neck opening 50 is fastened around the neck of the child. The right and left shoulder panels 46, 48 and the right and left side extensions 42, 44 are tucked around the child over the top of the restraint straps. Because it goes over the top of the straps, the garment 10 does not interfere in any way with the restraint system of the car seat. In addition, the garment 10 can be adjusted for comfort of the child, for example when the temperature changes, without unfastening the restraint system of the car seat. The garment 10 has the additional advantage that it covers the buckles of the restraint system so they are out of sight and out of mind to discourage a curious, restless or precocious child from unfastening the restrain system and putting him or herself in danger. When the child is not in a car seat, the garment 10 can be fastened behind the child and worn like a regular jumper or snowsuit. The garment 10 is also useful for other situations where a child is seated or lying down, such as while seated in a stroller, carriage, baby carrier, highchair, or the like.

While the present invention has been described herein with respect to the exemplary embodiments and the best mode for practicing the invention, it will be apparent to one of ordinary skill in the art that many modifications, improvements and subcombinations of the various embodiments, adaptations and variations can be made to the invention without departing from the spirit and scope thereof.

I claim:

1. A garment for covering a user, said garment comprising:

an upper portion sized and configured to cover a front of a torso of the user, said upper portion including:

a front panel, a right side extension extending from a right side of said front panel, a left side extension extending from a left side of said front panel, a right shoulder panel extending upward from said front panel and said right side extension, a left shoulder panel extending upward from said front panel and said left side extension, a right arm sleeve extending from said upper portion and located right of said front panel and below said right shoulder panel, a left arm sleeve extending from said upper portion and located left of said front panel and below said left shoulder panel, and a lower portion sized and configured to enclose the legs of the user, said lower portion extending downward from said upper portion, said lower portion attached to said upper portion such that a solid panel capable of entirely covering a torso and legs of the user from below the neck is formed, wherein said garment is sized and configured to allow the user to don said garment when in a seated position and whereby the user may don said garment by placing said garment in front of the user and placing an arm in each of said sleeves, then wrapping said left and right side extensions to the right and left of the user and placing the legs of the user in said lower portion.

2. The garment of claim 1, wherein said lower portion comprises a pouch sized and configured to enclosed both legs of the user.

3. The garment of claim 2, wherein said lower portion has a tightening member at a top edge thereof.

4. The garment of claim 3, wherein said tightening member is elastic attached to said top edge.

5. The garment of claim 3, wherein said tightening member is a drawstring.

6. The garment of claim 1, wherein said lower portion comprises:

a right leg sleeve connected to a bottom edge of said upper portion, said right leg sleeve having a right leg opening at a distal end thereof, and a left leg sleeve connected to said bottom edge of said upper portion, said left leg sleeve having a left leg opening at a distal end thereof.

7. The garment of claim 6, further comprising:

a right leg cuff connected to said distal end of said right leg sleeve, said right leg cuff having a first position, which leaves said right leg opening open, and a second position, which covers said right leg opening, and a left leg cuff connected to a distal end of said left leg sleeve, said left leg cuff having a first position, which leaves said left leg opening open, and a second position, which covers said left leg opening.

8. The garment of claim 1, further comprising a bib panel located on said front panel proximate a top edge thereof.

9. The garment of claim 8, wherein said bib is detachably attached to said front panel.

10. The garment of claim 8, wherein said bib is permanently attached to said front panel.

11. The garment of claim 1, further comprising:

a right cuff connected to a distal end of said right arm sleeve, said right cuff having a first position, which leaves said distal end of said right arm sleeve open, and a second position, which covers said distal end of said right arm sleeve, a left cuff connected to a distal end of said left arm sleeve, said left cuff having a first position, which leaves said distal end of said left arm sleeve open, and a second position, which covers said distal end of said left arm sleeve.

12. The garment of claim 11, wherein said right cuff is formed of a rectangular panel of material attached to said right arm sleeve along first and second side seams and a first end seam, and wherein said left cuff is formed of a rectangular panel of material attached to said left arm sleeve along third and fourth side seams and a second end seam.

13. The garment of claim 1, wherein an upper edge of said front panel has a concave cutout forming a neck opening.

14. The garment of claim 1, further comprising a neck tab extending upward from one of said right shoulder panel and said left shoulder panel and a connecting fastener for releasably connecting said neck tab to the other of said right shoulder panel and said left shoulder panel.

15. The garment of claim 1, further comprising a connecting fastener for releasably connecting said right and left side extensions.

16. The garment of claim 15, wherein said connecting fastener is a plurality of fasteners located on lateral sides of said right and left side extension.

17. A garment for covering a user, said garment comprising:

an upper portion sized and configured to cover a front of a torso of the user, said upper portion including:

a front panel having an upper edge and a lower edge, said upper edge having a concave cutout forming a neck opening, a right side extension extending from a right side of said front panel, a left side extension extending from a left side of said front panel, a right shoulder panel extending upward from said front panel and said right side extension, a left shoulder panel extending upward from said front panel and said left side extension, a right neck tab extending upward from said right shoulder panel, a left neck tab extending upward from said left shoulder panel, a first connecting fastener for releasably connecting said right and left neck tabs, a second connecting fastener for releasably connecting said right and left side extensions, a right arm sleeve extending from said upper portion and located right of said front panel and below said right shoulder panel, a left arm sleeve extending from said upper portion and located left of said front panel and below said left shoulder panel, a right cuff connected to a distal end of said right arm sleeve, said right cuff having a first position, which leaves said distal end of said right arm sleeve open, and a second position, which covers said distal end of said right arm sleeve, a left cuff connected to a distal end of said left arm sleeve, said left cuff having a first position, which leaves said distal end of said left arm sleeve open, and a second position, which covers said distal end of said left arm sleeve, and a lower portion attached to said lower edge of said front panel and forming a pouch sized and configured to enclose both legs of the user, said lower portion attached to said front panel such that a single contiguous panel is formed thereby entirely covering a torso and legs of the user from below the neck, wherein said garment is sized and configured to allow the user to don said garment when in a seated position and whereby the user may don said garment by placing said garment in front of the user and placing an arm in each of said sleeves, then wrapping said left and right side extension to the right and left of the user and placing the legs of the user in said pouch.

18. A garment for covering a user, said garment comprising:

an upper portion sized and configured to cover a front of a torso of the user, said upper portion including:

a front panel having an upper edge and a lower edge, said upper edge having a concave cutout forming a neck opening, a right side extension extending from a right side of said front panel, a left side extension extending from a left side of said front panel, a right shoulder panel extending upward from said front panel and said right side extension, a left shoulder panel extending upward from said front panel and said left side extension, a right neck tab extending upward from said right shoulder panel, a left neck tab extending upward from said left shoulder panel, a first connecting fastener for releasably connecting said right and left neck tabs, a second connecting fastener for releasably connecting said right and left side extensions, a right arm sleeve extending from said upper portion and located right of said front panel and below said right shoulder panel, a left arm sleeve extending from said upper portion and located left of said front panel and below said left shoulder panel, a right cuff connected to a distal end of said right arm sleeve, said right cuff having a first position, which leaves said distal end of said right arm sleeve open, and a second position, which covers said distal end of said right arm sleeve, a left cuff connected to a distal end of said left arm sleeve, said left cuff having a first position, which leaves said distal end of said left arm sleeve open, and a second position, which covers said distal end of said left arm sleeve, and a lower portion attached to said lower edge of said front panel and including:

a right leg sleeve connected to a bottom edge of said upper portion said leg having a right leg opening at a distal end thereof, and a left leg sleeve connected to said bottom edge of said upper portion having a left leg opening at a distal end thereof, said lower portion attached to said upper portion such that a solid panel capable of entirely covering a torso and legs of the user from below the neck is formed, wherein said garment is sized and configured to allow the user to don said garment when in a seated position and whereby the user may don said garment by placing said garment in front of the user and placing an arm in each of said sleeves, then wrapping said left and right side extension to the right and left of the user and placing the left leg of the user in said left leg sleeve and the right leg of the user in said right leg sleeve.

19. The garment of claim 18, further comprising a right leg cuff connected to said distal end of said right leg sleeve, said right leg cuff having a first position, which leaves right leg opening open, and a second position, which covers said right leg opening, and a left leg cuff connected to a distal end of said left leg sleeve, said left leg cuff having a first position, which leaves said left leg opening open, and a second position, which covers said left leg opening.

* * * * *